US006409038B1

(12) United States Patent
Karp

(10) Patent No.: US 6,409,038 B1
(45) Date of Patent: Jun. 25, 2002

(54) CONVERTIBLE TRAVEL MUG

(75) Inventor: Morry Karp, Beverly Hills, CA (US)

(73) Assignee: Berney-Karp, Inc., Los Angeles, CA (US)

( * ) Notice: Subject to any disclaimer, the term of this patent is extended or adjusted under 35 U.S.C. 154(b) by 0 days.

(21) Appl. No.: 09/737,417

(22) Filed: Dec. 14, 2000

Related U.S. Application Data

(60) Provisional application No. 60/226,657, filed on Aug. 21, 2000.

(51) Int. Cl.[7] ..... B65D 41/56

(52) U.S. Cl. ..... 220/212; 215/395

(58) Field of Search ..... 220/212, 212.5, 220/23.86, 628, 630, 629, 23.82, 592.16, 592.17, 771, 710.5, 729; D7/511, 536, 532; 215/395

(56) References Cited

U.S. PATENT DOCUMENTS 4,974,741 A * 12/1990 Gustafson et al. ..... 220/85 H
D322,218 S * 12/1991 Lynd ..... D9/353
5,158,193 A * 10/1992 Chen ..... 215/100 R
5,531,353 A * 7/1996 Ward et al. ..... 220/729
5,918,761 A * 7/1999 Wissinger ..... 220/713
D429,959 S * 8/2000 Otake ..... D9/398
D447,004 S * 8/2001 Green ..... D7/510

* cited by examiner

*Primary Examiner*—Lee Young
*Assistant Examiner*—Lien Ngo
(74) *Attorney, Agent, or Firm*—Kleinberg & Lerner LLP; Marvin H. Kleinberg; Marshall A. Lerner

(57) ABSTRACT

A mug that is normally too large to fit into a vehicle cup holder is fitted with a hollow base member that is appropriately sized. When the elements are combined, the resulting mug can be conveniently carried in a vehicle cup holder. The base member can be used to carry beverage accessories such sugar, sweetener, creamer, or tea or cocoa. It is also possible to store liquids in the base member, such as extra coffee if the user wishes more than the mug can hold. Gaskets can be used to prevent leakage and cover members can be provided to close the base member when not connected to the mug.

2 Claims, 5 Drawing Sheets

CONVERTIBLE TRAVEL MUG

This is a continuation-in-part of the provisional patent application Ser. No. 60/226,657, filed Aug. 21, 2000.

BACKGROUND OF THE INVENTION

1. Field of the Invention

The present invention relates to beverage containers and, more particularly to a cup or mug which can easily be converted into a beverage container that can readily fit into the cup holders currently being installed in vehicles. Further, the element which converts the cup to a traveling beverage container or travel mug may itself serve as a storage container.

2. Description of the Related Art

It has been known in the prior art to provide travel mugs which are adapted to fit into the cup holders found on most motor vehicles. These cup holders are generally sized to hold a conventional soda can and cups, or other containers of the same or smaller diameters can be carried in such holders.

Most of the mugs intended for beverages are generally larger in diameter and cannot, without alteration of some sort, fit into a beverage holder. Many cups or mugs include handles which would prevent a container of the appropriate diameter from fitting into the holder. Frequently the alteration is in the form of a generally cylindrical segment of smaller overall diameter than the upper portion of the mug so that a sufficient length can be placed within a cup holder and the mug will be stable. If the problem is caused by a handle, then the cylindrical segment need only be long enough to rest securely within the cup holder, without a change in diameter.

In the prior art, beverage containers have been provided with false bottoms that can serve as storage elements for packets of sweetener, creamer, powdered cocoa or coffee or even tea bags. Such false bottoms have generally the same diameter as the base of the mug or cup to which they attach and merely add to the overall height of the beverage container.

SUMMARY OF THE INVENTION

According to the present invention, a cylindrical base element adapted to fit into and be held by a vehicle cup holder is adapted to connect to a beverage container that would otherwise not fit into a cup holder. In a first embodiment, the beverage container is provided with male threads and the cylindrical base element is provided with mating female threads. An elastomeric gasket provides a resilient non slip base for the container and can act as a fluid tight seal when the base element is attached.

According to an alternative embodiment, the container base is provided with female threads. An elastomeric gasket element provides a container base as in the other embodiment. However, in this embodiment, the base portion can be fitted with a threaded closure which converts the base portion into a separate container which can be carried in a vehicle cup holder.

As in prior art devices, the base portion can be used for storage of materials for making beverages including products such as sweeteners, creamers, powdered or concentrated beverages and packets of tea or coffee. The base portion extends sufficiently deeply into the cup holder so that the combination is secure and stable. Moreover, due to its greater depth, the base portion may store larger volumes of solid or even liquid materials.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DESCRIPTION OF THE PREFERRED EMBODIMENTS

Figure 1:
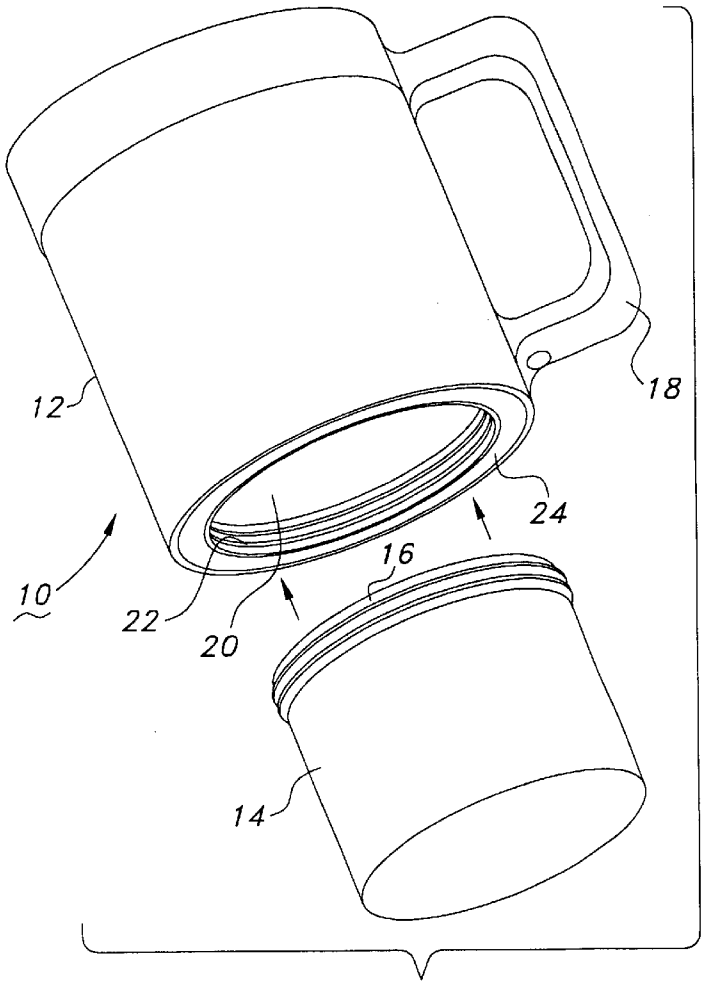
FIG. 1 is a perspective exploded view of a convertible travel mug according to a first embodiment.
Figure 2:
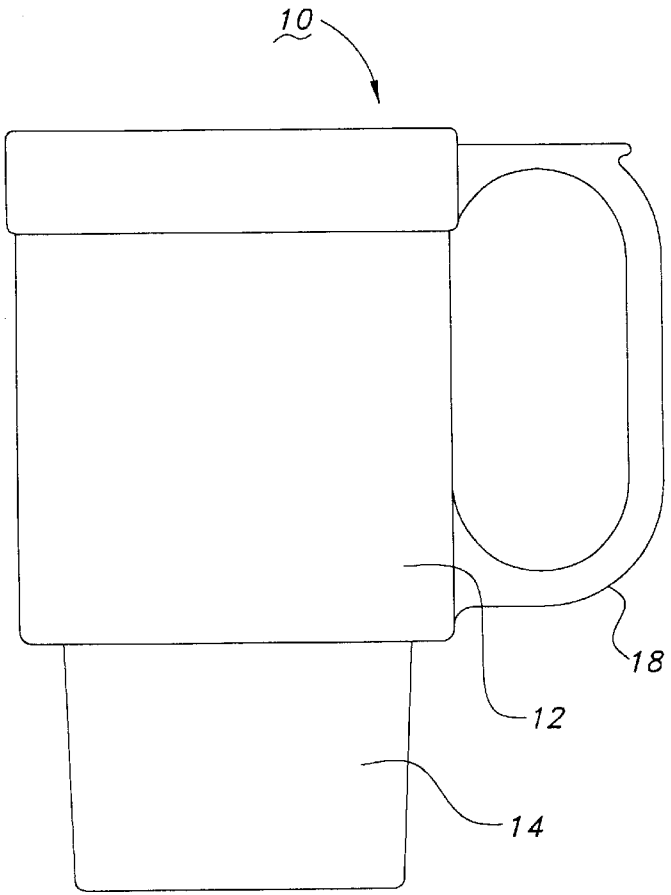
FIG. 2 is a side view of the embodiment of FIG. 1, showing the convertible mug with an attached base portion.

Turning first to FIGS. 1 and 2, there is shown a convertible cup or mug 10 according to the present invention. The mug 10 includes an upper, cup portion 12 and a lower, base portion 14 which may be considered an auxiliary cup. The lower, base portion 14is hollow and may store liquids or dry materials such as packets of sugar, sweeteners, tea bags, instant coffee, cocoa or chocolate or other powdered beverages. In the mug 10 of the preferred embodiment, the diameter of the cup portion 12 is normally greater than could be accommodated by the cup holders found in modern motor vehicles.

The base portion 14 has, at its upper circumference, a threaded section 16. The base portion 14 has a diameter which is normally equal to or slightly smaller than the openings in the cup holders found in modern motor vehicles. The height of the base portion can vary but is intended to be adequate to support the cup portion 12 when coupled together in a cup. holder with reasonable security.

The cup portion includes a handle 18 and a recessed bottom 20 and an internally threaded circumferential wall 22 which is adapted to receive the threaded section 16 of the base portion 14. The circumferential wall segment 22 has affixed to it an elastomeric ring 24 upon which the cup portion 12 may rest when not fitted with the base portion 14.

The base portion 12 is attached to the cup portion by inserting the threaded section 16 of the base portion into the threads of the circumferential wall 22. When so combined, the resulting travel mug can easily and securely carried in the cup holder of the modern vehicle.

Figure 3:
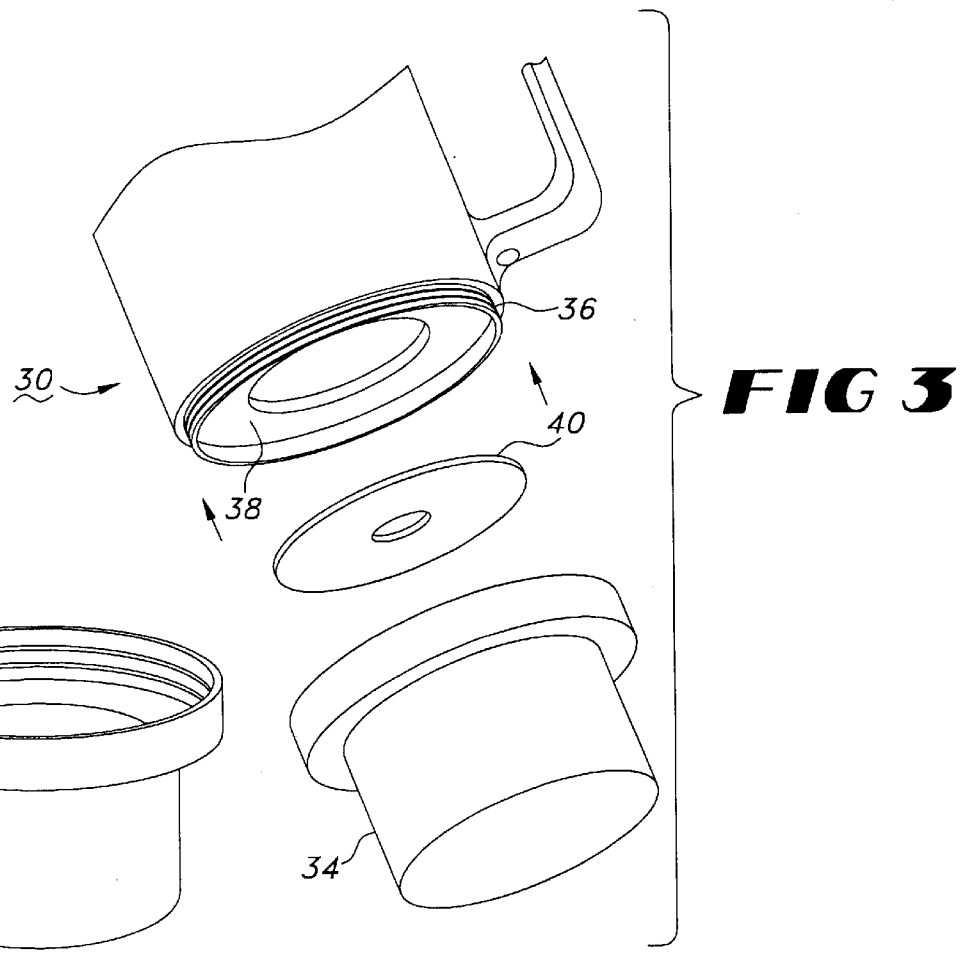
FIG. 3 is a perspective exploded view of a convertible mug according to a first alternative embodiment.
Figure 4:
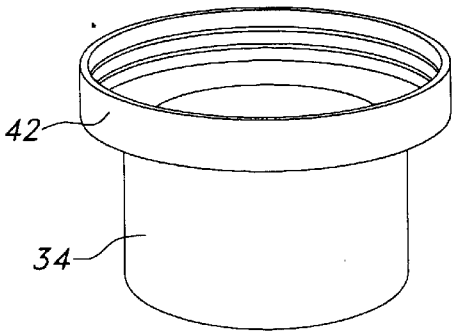
FIG. 4 is a perspective view of the base portion of the convertible mug of FIG. 3.
Figure 5:
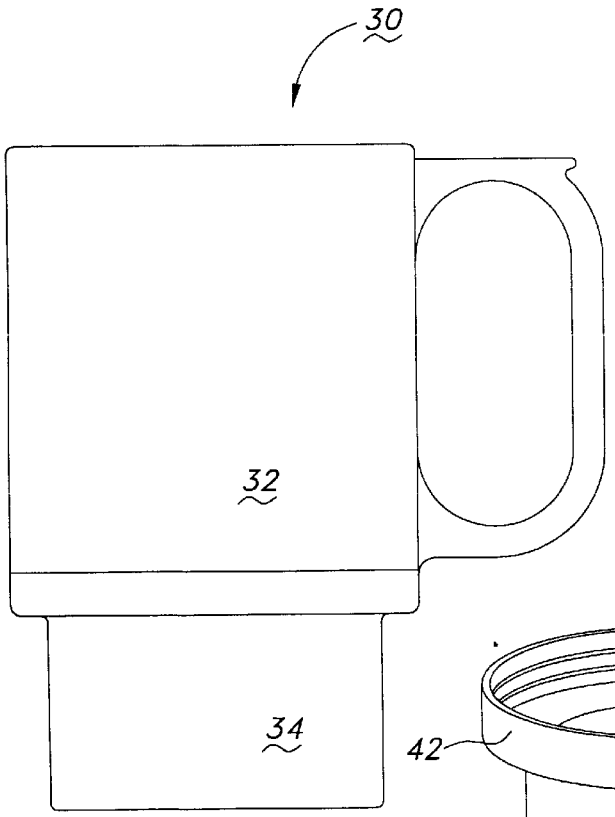
FIG. 5 is a side view of the mug of FIG. 3 assembled.

FIGS. 3, 4 and 5 show an alternative embodiment of the convertible travel mug of the present invention. The travel mug 30 includes an upper cup portion 32 and a lower base portion 34. As in the cup portion 12 of FIGS. 1 and 2, the cup portion 32 has at its base an externally threaded portion 36 which extends below the bottom of the cup portion 32 to create a recess 38 into which an elastomeric ring 40 may be placed to provide a soft, non slip interface between the cup portion 32 and any surface upon which it may rest.

In this embodiment, the base portion 34 is provided with an interiorly threaded circumferential wall portion 42 of a diameter which approximates that of the cup portion 32.

This allows the wall portion 42 to fit over and mate with the threads 36 of the cup portion 32. As with the other embodiment, the diameter of the cup portion 32 is greater than the opening of a conventional cupholder while the diameter of the base portion 34 is comparable to the opening of a cup holder and can be easily accommodated therein.

FIG. 5 shows the converted travel mug 30 after the base portion 34 has been threaded on to the cup portion 32. The resultant mug 30 is intended to be stable and secure when being carried in the cup holder of a vehicle. Moreover, the elastomeric ring 40 can serve as a sealing element between the cup 32 and base 34 portions when coupled together, thereby securing the contents of the base portion 34.

Figure 6:
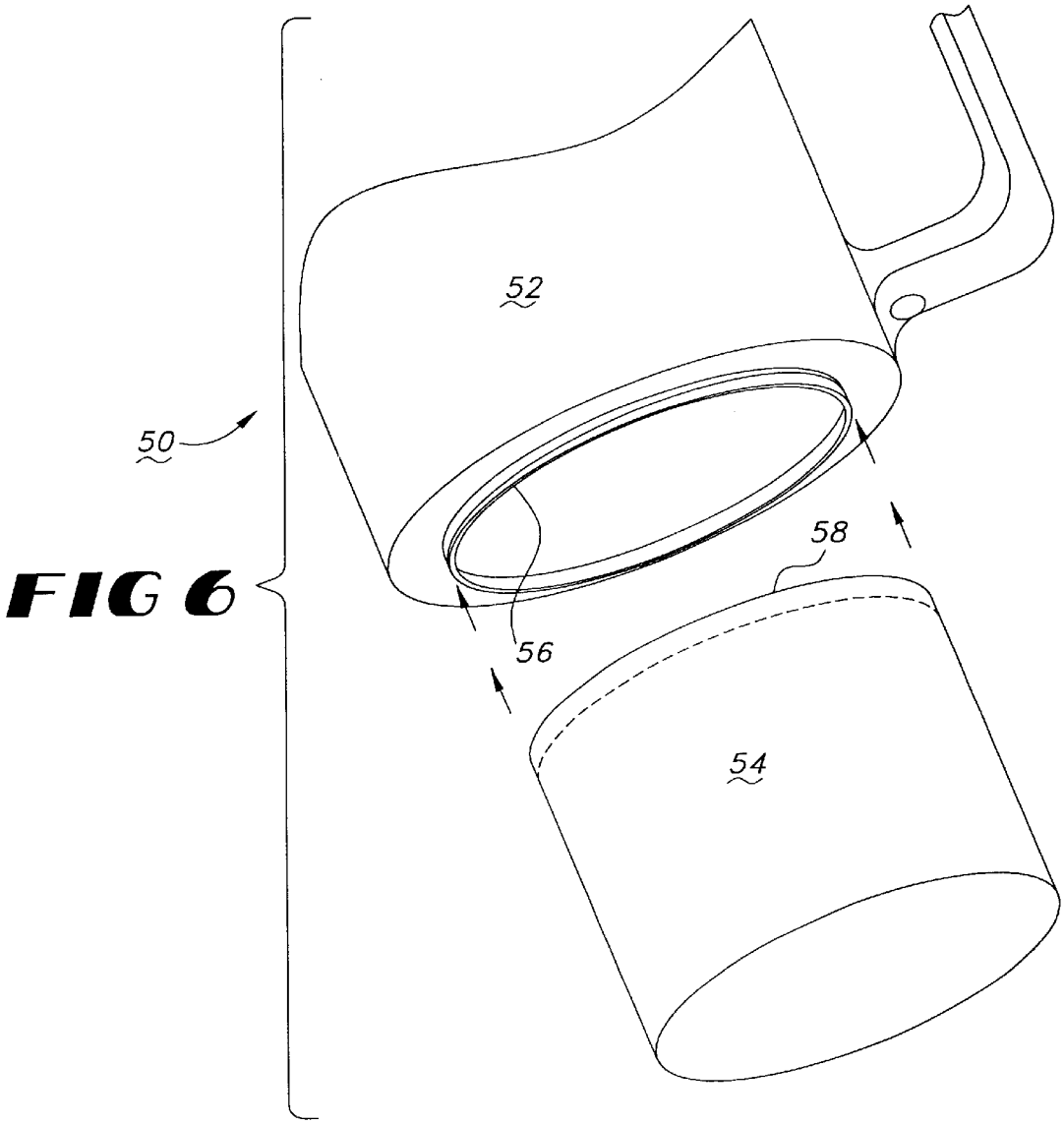
FIG. 6 is an exploded view of a convertible mug according to a second alternative embodiment.

Another alternative embodiment is shown in FIG. 6. In this embodiment 50, which includes a cup portion 52 and a base portion 54, the cup portion 52 is fitted, at its bottom, with a exteriorly threaded circumferential wall segment 56. The base portion 54 has an interior thread 58 in the circumferential wall which can receive the wall segment 56. The diameter of the cup portion 52 is greater than the opening in a cup holder and the diameter of the base portion 54 is small enough to fit into a cup holder.

Figure 7:
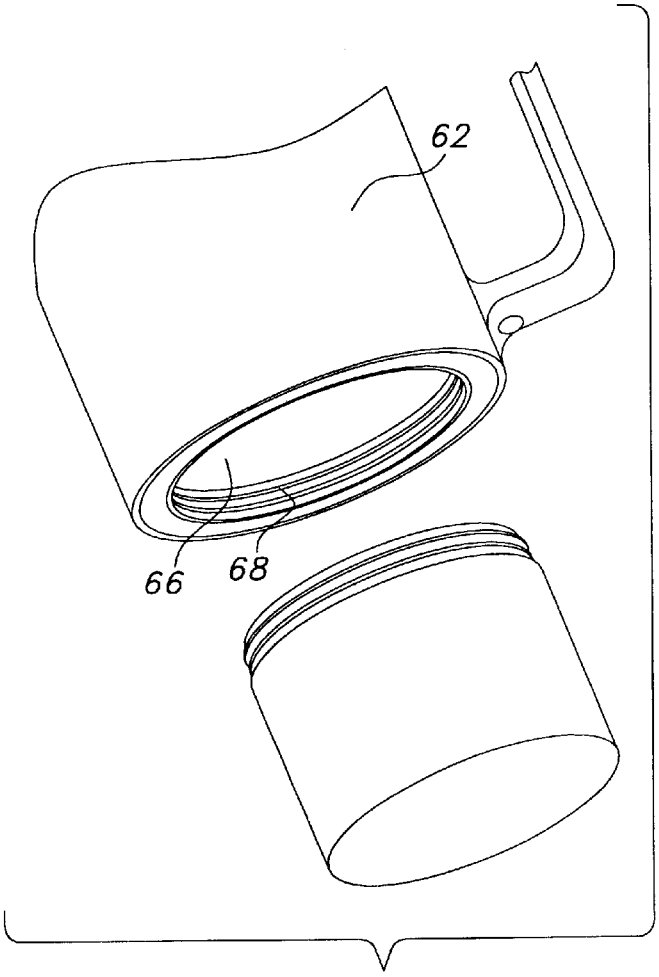
FIG. 7 is a perspective exploded view of a convertible mug according to a third alternative embodiment.
Figure 8:
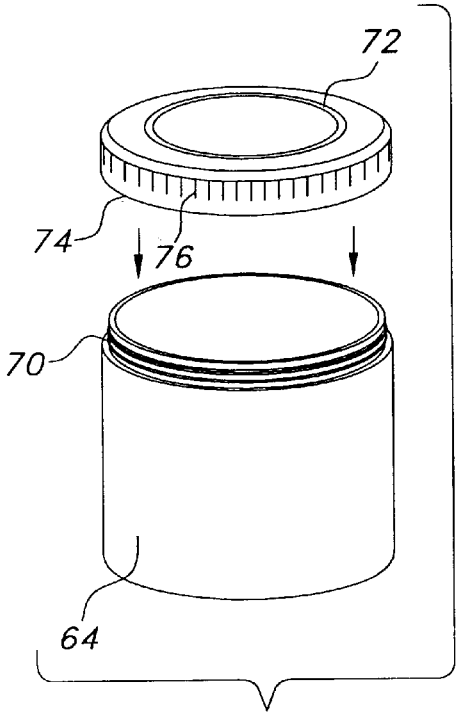
FIG. 8 is a perspective exploded view of the base portion of the mug of FIG. 7, showing a closure top for the base portion.

The embodiment illustrated in FIGS. 7 and 8, provides a covered container which can be used separately from the combination. To accomplish this, a convertible mug 60 also includes a cup and base portion, 62, 64. The cup portion 62 has, its bottom, a recess 66 with a threaded wall 68. The base portion 64 includes an exteriorly threaded recessed wall 70. A cap element 72 has interior threads 74 on the wall segment 76 that is fitted over the recessed wall 70 of the base portion 64. In a variation, the cap element may be adapted to fit over the bottom of the base portion for storage when it is not needed to close the base portion.

Figure 9:
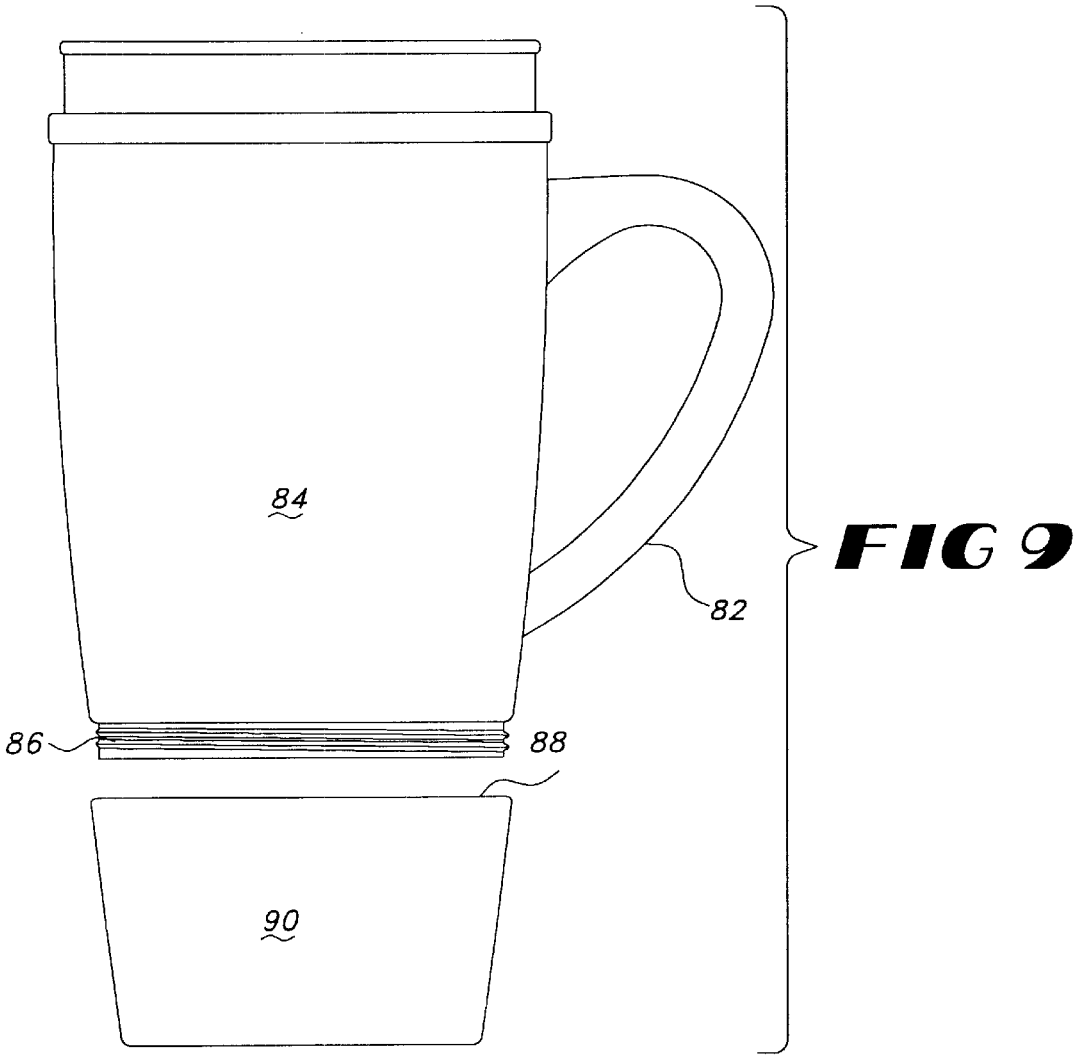
FIG. 9 is an exploded side view of a convertible mug according to a fourth alternative embodiment of the invention.

In FIG. 9, there is shown an alternative embodiment of a convertible mug 80 which may have a diameter that is small enough to fit into a cup holder but which cannot easily be used in a cup holder because of a handle 82 which cannot be fitted into the opening of a conventional cup holder. Although the mug 80 has a slight taper, the presence of the handle requires an extension that can rest in the cup holder comfortably and reliably. In the embodiment shown, the cup portion 84 has exterior male threads 86 at its bottom and corresponding female threads 88 are found in the base portion 90.

Here, the base portion 90 need only be long enough to provide a stable cooperation between the mug 80 and the cup holder of the vehicle so that it will not easily tip out.

In all of the embodiments, a removable base portion is provided that converts a mug into a travel mug that can be accommodated in the cup holder of a vehicle.

While there has been disclosed and described a convertible travel mug in several embodiments, the scope of the invention should be limited only by the scope of the claims appended hereto.

What is claimed as new is:

1. A travel mug adapted to fit within a vehicle mounted cup receptacle comprising:

an upper cup portion having a circumferential side wall and a bottom, said upper cup portion having a diameter greater than the diameter of the vehicle mounted cup receptacle;

a base portion having a circumferential side wall and a bottom, said base portion having a diameter approximately comparable to the diameter of the vehicle mounted cup receptacle;

coupling means integral with said upper cup bottom and said base portion side wall for separably joining said cup and base portions said coupling means including a recess in said upper cup bottom with peripheral threading and said base portion has complementary threading about the upper part of said base portion side wall, said upper part of said base portion side wall being adapted to fit within said recess so that the combination can be carried in a vehicle mounted cup receptacle; and a cover member, having side walls with peripheral threading complementary to said complementary threading on said base portion side wall whereby said base portion can alternatively be fitted with said cover member and into said upper cup bottom recess.

2. A travel mug adapted to fit within a vehicle mounted cup receptacle comprising:

an upper cup portion having a circumferential side wall and a bottom portion;

a handle member mounted on said cup portion side wall and extending outward beyond the opening of the vehicle mounted cup receptacle;

a base portion having a circumferential side wall and a bottom portion, said base portion having a diameter approximately comparable to the diameter of the vehicle mounted cup receptacle;

coupling means integral with said upper cup bottom and said base portion for separably joining said cup and base portions, said coupling means including a recess in said upper cup bottom with peripheral threading and said base portion having complementary threading about the upper part of said base portion circumferential side wall, said upper part of said base portion circumferential side wall being adapted to fit within said recess so that the combination can be carried in a vehicle mounted cup receptacle, notwithstanding the handle member on said cup portion; and a cover member, having side walls with peripheral threading complementary to the said complementary threading on said base portion side wall whereby said base portion can alternatively be fitted with said cover member and into said upper cup recess.

* * * * *